United States Patent [19]

Unti et al.

[11] 3,950,048

[45] Apr. 13, 1976

[54] CARRYING AND SUPPORT HANDLE FOR BINDERS

[75] Inventors: Louis Aloyious Unti, Chicago; Jack Harold Michaelis, Elmhurst; Frank John Malcik, Berwyn, all of Ill.

[73] Assignee: Swingline, Inc., Long Island City, N.Y.

[22] Filed: July 10, 1974

[21] Appl. No.: 486,965

[52] U.S. Cl. ..... 312/184; 224/45 P

[51] Int. Cl.[2] ..... B42F 15/00

[58] Field of Search ..... 224/45 P, 45 F, 45 R; 211/124; 312/183, 184; 248/317

[56] References Cited

UNITED STATES PATENTS

| | | | |
|---|---|---|---|
| 3,790,242 | 2/1974 | Sullivan | 312/184 |

FOREIGN PATENTS OR APPLICATIONS

| | | | |
|---|---|---|---|
| 1,130,791 | 7/1962 | Germany | 312/184 |
| 489,801 | 8/1938 | United Kingdom | 312/184 |
| 1,927,345 | 12/1970 | Germany | 312/184 |

*Primary Examiner*—Robert J. Spar
*Assistant Examiner*—Kenneth Noland
*Attorney, Agent, or Firm*—Pennie & Edmonds

[57] ABSTRACT

A binder carrying handle for ready insertion in and support of a bound volume of sheets in which the handle is engageable with posts in the binder volume. The handle is flexible and shaped to facilitate its insertion and removal.

7 Claims, 7 Drawing Figures

CARRYING AND SUPPORT HANDLE FOR BINDERS

BACKGROUND OF THE INVENTION

Binders and other types of bound volumes containing computer printouts, drawings, displays, samples or other sheets are in many instances large enough and heavy enough to require a carrying and support handle for easy transportation and for supporting the binder during storage on a rack or other supporting apparatus.

Prior carrying and support handles have been difficult to insert and remove from the binder with some handles, due to their shape, size and stiffness, requiring opening of the post binder to permit insertion of the handles.

The present invention utilizes flexibility and a tapered edge to substantially improve the operation and usefulness of prior post binder carrying handles.

SUMMARY OF THE INVENTION

Broadly, the carrying handle is an elongated element having a flexible backbone and depending web portions at each end. One web is introduced into the back or spine of the assembled binder by wedging the web between the sheets of the binder until it is engaged with one of the posts of the binder. The backbone is then flexed to a bow shape to permit the other web to be similarily inserted and engaged with the other post of the binder. When the backbone is allowed to restore itself to its normal shape the webs and their posts are engaged to permit the handle to be used to carry and support the binder during transportation and storage.

It is a feature of the invention that the webs have blade-like edges to facilitate their wedging insertion.

DESCRIPTION OF THE PREFERRED EMBODIMENT

Figure 1:
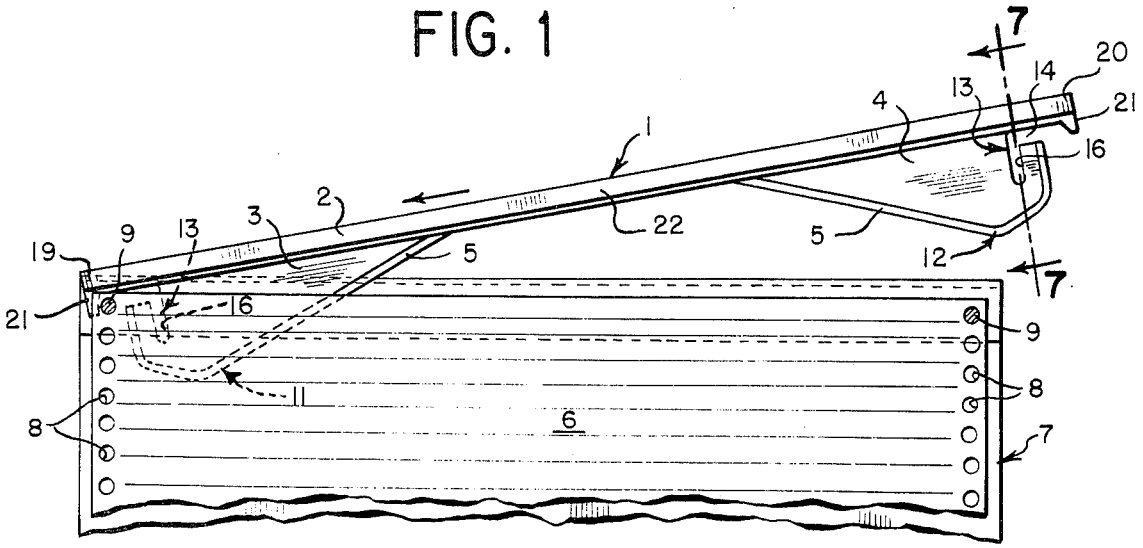
FIG. 1 is an elevational view of a post binder with the first end of the carrying handle inserted between sheets of the binder.
Figure 2:
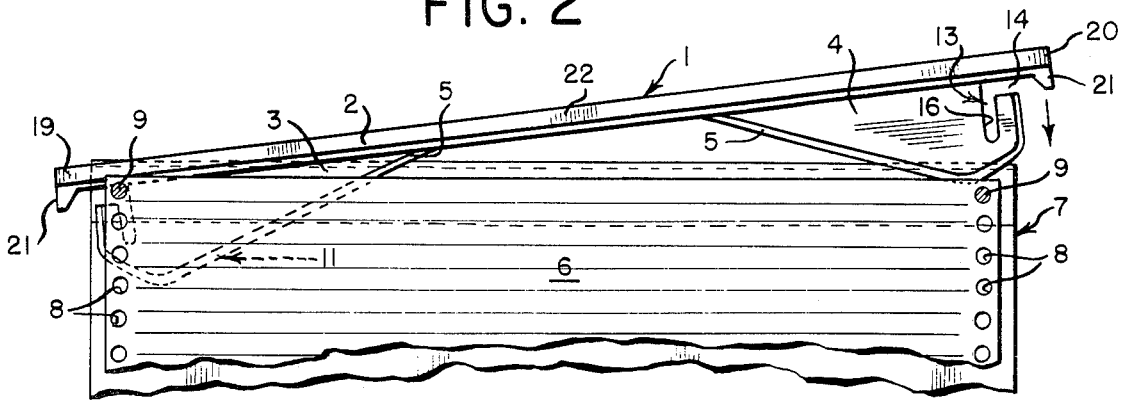
FIG. 2 is an elevational view of the post binder with the first end engaged to a post.
Figure 3:
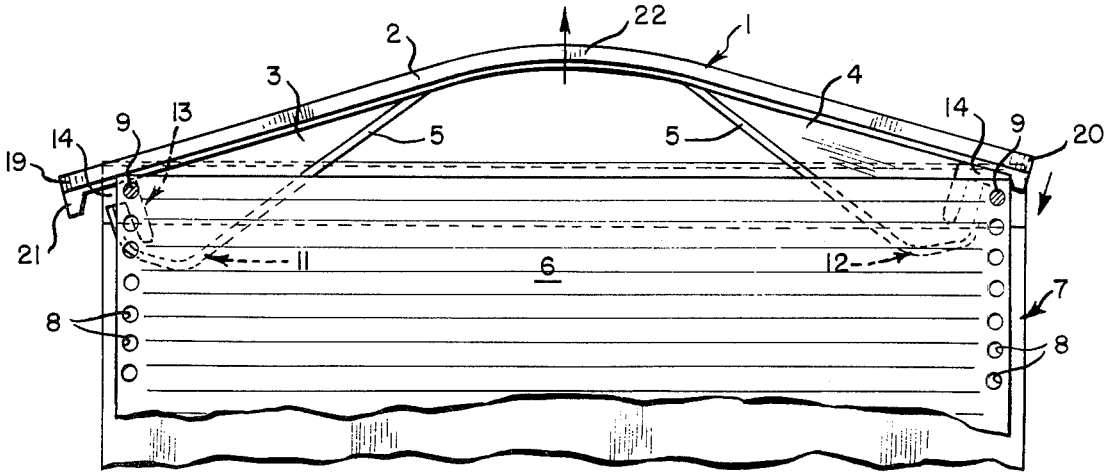
FIG. 3 shows the second end of the handle inserted into the binder as the handle is flexed in a bow shape.
Figure 4:
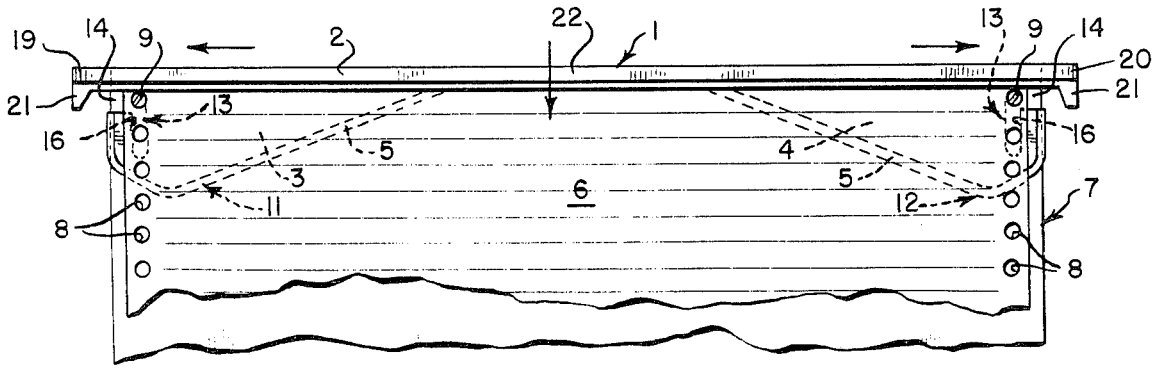
FIG. 4 shows the unflexed handle with both web portions inserted in the binder.
Figure 7:
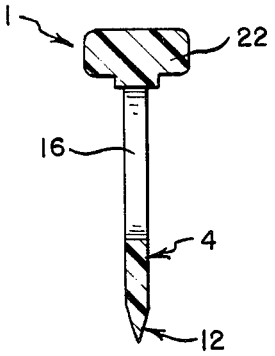

Referring to the Figures, handle 1 includes backbone 2 which has a cross sectional shape defined by a large rectangle on top of a substantially smaller rectangle (FIG. 7). The two rectangles are sized and shaped to give flexibility plus adequate strength for carrying the weight of the binder. Other cross sectional shapes providing adequate flexibility and stiffness for the weight and size binder may be used. The backbone 2 is made of plastic or other suitable resilient material so that it can be repeatedly flexed to a bow shape as shown in FIG. 3 and thereafter restore itself to the configuration of FIG. 1 without breaking or acquiring any appreciable permanent set. At either end of backbone 2 are positioned depending webs 3 and 4 which are preferably integrally formed with the backbone 2.

Each web 3 and 4 has blade-shaped edges 5 to facilitate wedging the webs between tightly packed sheets 6 of binder 7. Sheets 6 have rows of holes 8 with upper holes 8 receiving posts 9.

Webs 3 and 4 also carry elbow sections 11 and 12, respectively, which ease the insertion of the webs into the back or spine of the binder since only a small portion of each web is required to be pushed into the binder during its initial entrance. After a web has started into the binder through the entrance of the elbow sections 11 or 12, then greater force can be applied to force it in further and to accomplish the movement necessary for engagement with posts 9.

Open web slots 13 include a slot portion 14 generally parallel to the backbone 2 and a slot portion 16 perpendicular to the backbone.

Backbone 2 has overhanging ends 19 and 20 which extend beyond webs 3 and 4 to serve as devices for supporting the hanger on a pair of spaced parallel rods or other suitable support arrangements. Lips 21 on overhanging ends 19 and 20 serve to prevent the hanger from moving off its support.

The handle 1 may be inserted into a binder in a number of ways. We have found that the sequence of steps shown in FIGS. 1–5 is a convenient technique.

Figure 5:
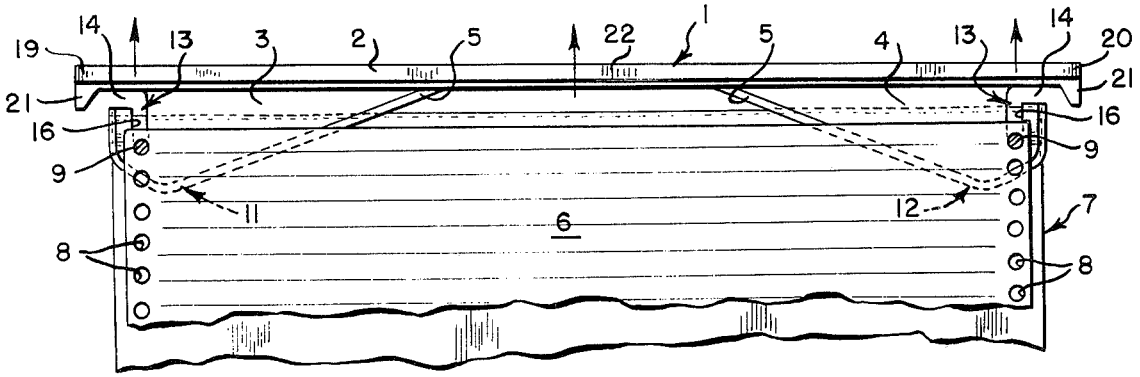
FIG. 5 shows the handle pulled up from the FIG. 4 position to further engage the handle with the posts.
Figure 6:
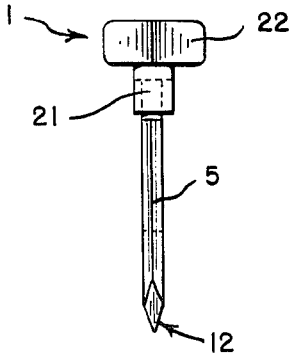
FIG. 6 is an end view of the handle and FIG. 7 is a sectional view along line 7—7 of FIG. 1.

The handle of the present invention may be used with a binder of the type having dozens of tightly packed sheets 6 which is held together with posts 9 and has its back or spine open to receive the carrying handle. The handle including its webs are proportioned to leave a space between the hand gripping portions 22 and the back of the binder (FIG. 5). The carrying handle may be removed by flexing the handle to free the webs from the posts 9.

We claim:

1. A post binder carrying handle capable of engagement with and disengaged from the posts of a binder of tightly packed sheets comprising a. an elongated body portion having a central hand gripping area and depending web end portions on either side of the gripping area, said body portion capable of being flexed to a bow shape substantially parallel to the plane of the sheets;

b. each of the web end portions having a blade edge portion for assisting in the insertion of the web portions between and movement relative to said tightly packed sheets; and c. post engaging means on each end portion for engagement with the posts of the binder whereby one end of the handle may be engaged with one portion of the binder and the handle flexed in a bow shape to assist in insertion of the other end of the handle.

2. The carrying handle of claim 1 in which the web end portions and post engaging means are proportioned to provide a space between the central handle gripping area and the spine of the binder when the handle is engaged with the posts to permit a hand to grip the gripping area and carry the binder.

3. The carrying handle of claim 1 in which the body portion overhangs each of the binder ends to provide means for supporting the body portion on a supporting means after the carrying handle has been engaged with the binder.

4. A post binder carrying handle capable of engagement with and disengagement from the posts of a binder of tightly packed sheets comprisng a. an elongated body portion having a central hand gripping area and depending web end portions on either side of the gripping area, said body portion capable of being flexed to a bow shape substantially parallel to the plane of the sheets b. each of the web end portions having a blade edge portion for assisting in the insertion of the web portions between and movement relative to said tightly packed sheets; and c. post engaging means on each end portion for engagement with the posts of the binder whereby one end of the handle may be engaged with one portion of the binder and the handle flexed in a bow shape to assist in insertion of the other end of the handle.

5. A post binder carrying handle capable of engagement with and disengagement from the posts of a binder of tightly packed sheets comprising:

a. an elongated body portion having a central hand gripping area and depending web end portions on either side of the gripping area, said body portion capable of being flexed to a bow shape substantially parallel to the plane of the sheets;

b. each of the web end portions having a blade edge portion for assisting in the insertion of the web portions between and movement relative to said tightly packed sheets;

c. post engaging means on each end portion for engagement with the posts of the binder; and d. said engaging means cooperating with said posts for maintaining engagement with said posts while said body portion is in an unflexed disposition and for engaging and disengaging said posts while said body portion is in a flexed disposition.

6. The carrying handle of claim 5 wherein said engaging means includes slots facing in a direction opposite to each other and away from the central handle gripping area.

7. The carrying handle of claim 6 wherein said webs define an elbow section for allowing only a small portion of the web to be initially inserted between the sheets to facilitate insertion of the remaining portions of the web.

* * * * *